United States Patent [19]

Littlewood

[11] Patent Number: 4,462,925

[45] Date of Patent: Jul. 31, 1984

[54] STABLE SOLUTIONS OF OPTICAL BRIGHTENERS

[75] Inventor: Peter S. Littlewood, Ilkley, England

[73] Assignee: Sandoz Ltd., Basel, Switzerland

[21] Appl. No.: 325,104

[22] Filed: Nov. 27, 1981

Related U.S. Application Data

[63] Continuation-in-part of Ser. No. 230,547, Feb. 2, 1981, abandoned.

[30] Foreign Application Priority Data

Feb. 5, 1980 [GB] United Kingdom ..... 8003862

[51] Int. Cl.[3] ..... C09K 11/06

[52] U.S. Cl. ..... 252/301.28; 252/301.21; 252/301.25; 252/301.27; 252/301.32

[58] Field of Search ..... 252/301.32, 301.21, 252/301.25, 301.27, 301.28

[56] References Cited

U.S. PATENT DOCUMENTS

| | | | |
|---|---|---|---|
| 4,001,138 | 1/1977 | Lohmann | 252/301.27 |
| 4,036,778 | 6/1977 | Lohmann | 252/301.27 |
| 4,189,589 | 2/1980 | Meyer et al. | 548/327 |

FOREIGN PATENT DOCUMENTS

| | | |
|---|---|---|
| 2038323 | 7/1980 | United Kingdom . |
| 1577127 | 10/1980 | United Kingdom . |

*Primary Examiner*—Arthur P. Demers

*Attorney, Agent, or Firm*—Gerald D. Sharkin; Richard E. Vila; Thomas C. Doyle

[57] ABSTRACT

A stable aqueous solution comprising (a) 5–25% by weight of an optical brightening agent of formula I

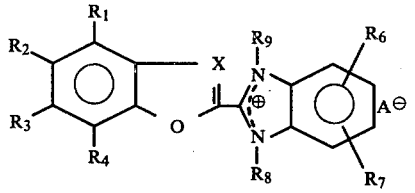

I in which $R_1$ to $R_9$, X and $A^{\ominus}$ are defined in the specification (b) 5–70% by weight of an organic monobasic acid or a mixture of organic monobasic acids selected from formic, acetic, propionic, butyric, glycollic and lactic acids, (c) 0–45% by weight citric acid (d) 5–55% by weight water the total amount of organic acids present being at least 40% by weight of the total composition, and the total amount of components a, b, c and d being at least 90% of the total solution.

22 Claims, No Drawings

STABLE SOLUTIONS OF OPTICAL BRIGHTENERS

This application is a continuation-in-part of my copending application Ser. No. 230,547, filed Feb. 2, 1981 and now abandoned.

This invention relates to stable aqueous solutions of certain benzimidazole optical brighteners.

The invention provides a stable aqueous solution comprising (a) 5–25% by weight of an optical brightening agent of formula I

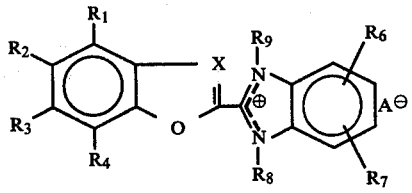

I in which X is N or $CR_5$, $A^{\ominus}$ is an anion and (1) when X is N:

$R_1$, $R_2$ and $R_4$ are hydrogen $R_3$ is $C_{1-4}$alkoxy, unsubstituted or monosubstituted by phenyl or ($C_{1-4}$alkoxy)carbonyl;

one of $R_6$ and $R_7$ is hydrogen or methyl, the other being hydrogen, and $R_6$ and $R_7$ are in the 3- and 4-position respectively, $R_8$ is $C_{1-4}$alkyl unsubstituted or monosubstituted by phenyl or ($C_{1-4}$alkoxy)carbonyl, and $R_9$ is $C_{1-4}$alkyl, or (2) when X is $CR_5$, $R_5$ is hydrogen, $C_{1-4}$alkyl, phenyl or phenyl substituted by methyl and/or methoxy;

$R_1$ is hydrogen, halogen, $C_{1-4}$alkyl, $C_{1-4}$alkoxy or together with $R_2$ forms a fused benzene ring $R_2$ is hydrogen, halogen, $C_{1-4}$alkyl, $C_{1-4}$alkoxy, —COOR, —CONRR or —$SO_2R'$, in which each R independently is H or $C_{1-4}$alkyl and R' is —OH, $C_{1-4}$alkyl, $C_{1-4}$alkoxy, or —NRR;

or together with $R_1$ or $R_3$ forms a fused benzene ring;

$R_3$ is hydrogen, halogen, $C_{1-4}$alkyl, $C_{1-4}$alkoxy or together with $R_2$ or $R_4$ forms a fused benzene ring $R_4$ is hydrogen, halogen, $C_{1-4}$alkyl, $C_{1-4}$alkoxy or together with $R_3$ forms a fused benzene ring;

$R_6$ is hydrogen, halogen, $C_{1-4}$alkyl, $C_{1-4}$alkoxy, phenyl, ($C_{1-4}$alkyl)sulphonyl or phenylsulphonyl;

$R_7$ is hydrogen, halogen, $C_{1-4}$alkyl or $C_{1-4}$alkoxy;

$R_8$ is $C_{1-4}$alkyl unsubstituted or substituted by phenyl; $C_{2-4}$hydroxyalkyl; cyanoethyl; phenyl unsubstituted or monosubstituted by halogen, $C_{1-4}$alkyl or $C_{1-4}$alkoxy; or $C_{4-8}$cycloalkyl;

and $R_9$ is $C_{1-4}$alkyl unsubstituted or substituted by phenyl, $C_{2-4}$hydroxyalkyl, ($C_{1-4}$alkoxy)-$C_{2-4}$alkyl, —$CH_2CN$, —$CH_2CONH_2$ or —$CH_2$—COOR" where R" is $C_{1-4}$alkyl, (b) 5–70% by weight of an organic monobasic acid or a mixture of organic monobasic acids selected from formic, acetic, propionic, butyric, glycollic and lactic acids, (c) 0–45% by weight citric acid (d) 5–55% by weight water the total amount of organic acids present being at least 40% by weight, preferably 45–65% by weight of the total composition.

Preferably 10–45% citric acid is present.

Preferably the total amount of components a, b, c and d is at least 90% of the total solution. More preferably the total amount of components a, b, c and d is 95%, most preferably the total amount of components a, b, c and d is 97%.

Preferably substantially the only solvents present are components b, c and d.

Preferred compounds of formula I in which X is N are those of formula I'

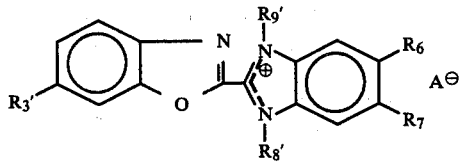

I' in which $R_3'$ is methoxy or ($C_{1-2}$alkoxy)carbonylmethoxy $A^{\ominus}$, $R_6$ and $R_7$ are as defined above, $R_8'$ is $C_{1-2}$alkyl, unsubstituted or monosubstituted by phenyl or ($C_{1-4}$alkoxy)carbonyl, and $R_9'$ is methyl or ethyl.

Particularly preferred is the compound of formula I' in which $R_3'$ is methoxy, $R_6=R_7=H$, and $R_8'=R_9'=$methyl, particularly the salt form in which $A^{\ominus}$ is a halide or $CH_3SO_4^{\ominus}$ anion or mixtures thereof. The term 'halogen' used herein means F, Cl or Br, and 'halide' means $F^{\ominus}$, $Cl^{\ominus}$ or $Br^{\ominus}$.

Preferred compounds of formula I in which X is $CR_5$ are those of formula I"

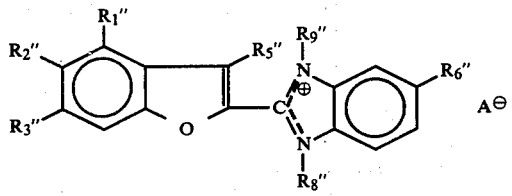

I"

in which $R_1''$ and $R_2''$ are each hydrogen or together form a fused benzene ring $R_3''$ is hydrogen, methoxy or methyl $R_5''$ is hydrogen or methyl $R_6''$ is hydrogen, methyl, methoxy, chlorine or methylsulphonyl $R_8''$ is methyl, phenyl or benzyl and $R_9''$ is methyl or benzyl.

Of the compounds of formula I' and I", those of formula I' are preferred.

Component (b) is preferably formic, acetic, glycollic or lactic acid, or mixtures thereof. Acetic acid, glycollic acid and mixtures thereof are particularly preferred.

Suitable compositions contain 7–20% by weight of component (a) and 10–30% by weight of component (b) and 25–40% by weight of component (c) or 45–65% by weight of component (b) and no component (c); the former type being especially suitable.

The compositions of the invention may contain minor amounts of additional components, for example scented materials such as pine oil to mask any unpleasant odour from the organic acids.

The optical brighteners of formula I are known, and their preparation is described for example in German Offenlegungsschrift 2 733 439 and Swiss Pat. No. 593 967.

The compositions of the invention may be prepared in conventional manner by stirring the components together, e.g. at room temperature, until a homogeneous solution results.

The resulting compositions are useful as aqueous concentrates which may be diluted as required to give an aqueous treatment bath for the optical brightening of textile fibres, particularly of polyacrylonitrile. The compositions are stable, that is, they do not deposit any solid material on storage for up to several months at temperatures between 0° C. and 45° C.

The following Examples, in which all parts and percentages are by weight, illustrate the invention.

EXAMPLE 1

150 Parts of the optical brightener of formula

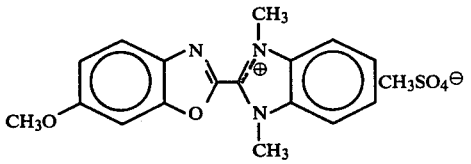

were stirred at 20° C. with 250 parts of water and 600 parts of glacial acetic acid, to give a clear pale yellow solution, stable at 0° C., ambient temperature and 45° C. for at least 12 months.

EXAMPLE 2

150 Parts of the optical brightener of Example 1 were stirred at 20° C. with 314 parts water, 50 parts glacial acetic acid, 300 parts anhydrous citric acid and 186 parts of 70% wt. aqueous glycollic acid until a clear pale yellow solution was obtained having the following composition (% by wt.)

(a) optical brightener 15%
(b) monobasic acids 18% (acetic acid 5%, glycollic acid 13%)
(c) citric acid 30%
(d) water 37%.

The composition is stable at 0° C., ambient temperature and 45° C. for at least 12 months, and has very little odour.

EXAMPLE 3

150 Parts of the optical brightener of formula

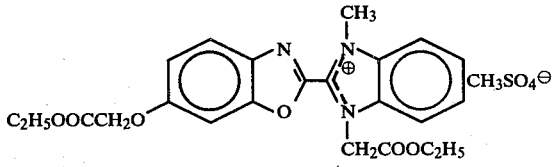

were stirred at 20° C. with 250 parts water, 100 parts glacial acetic acid, 300 parts anhydrous citric acid and 200 parts 70% glycollic acid, to give a clear pale yellow liquid stable at 0° C. for at least 6 months and having the following composition: (% by wt.)

(a) optical brightener 15%
(b) monobasic acids 24% (acetic acid 10%, glycollic acid 14%)
(c) citric acid 30%
(d) water 31%.

EXAMPLE 4

150 Parts of the optical brightener of formula

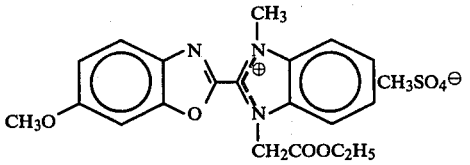

were stirred at 20° C. with 250 parts water, 300 parts citric acid and 300 parts 70% glycollic acid to give a pale yellow odourless solution, stable at 0° C. for at least 6 months and having the composition (a) optical brightener 15%
(b) glycollic acid 21%
(c) citric acid 30%
(d) water 34%.

EXAMPLE 5

A solution the same as that of Example 3 was formulated except that the optical brightener of formula

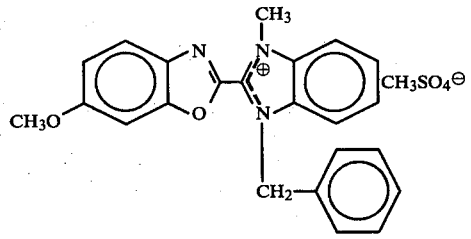

was used instead of the optical brightener of Example 3. A pale yellow solution with very little odour and stable at 0° C. for at least 6 months was obtained.

EXAMPLE 6

A solution the same as that of Example 3 was formulated except that the optical brightener of formula

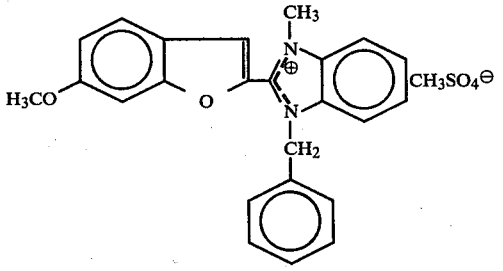

was used instead of the optical brightener of Example 3.

EXAMPLE 7

A solution the same as that of Example 1 was formulated except that the optical brightener of formula

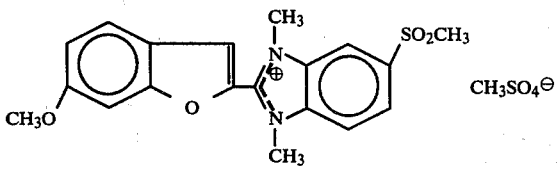

was used instead of the optical brightener of Example 1.

What is claimed is:

1. A stable aqueous solution comprising (a) 5–25% by weight of an optical brightening agent of formula I

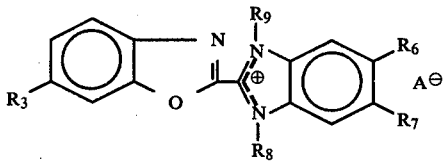

I in which $A^{\ominus}$ is an anion, $R_3$ is $C_{1-4}$alkoxy, unsubstituted or monosubstituted by phenyl or by ($C_{1-4}$alkoxy)carbonyl;

one of $R_6$ and $R_7$ is hydrogen or methyl and the other is hydrogen;

$R_8$ is $C_{1-4}$alkyl unsubstituted or monosubstituted by phenyl or by ($C_{1-4}$alkoxy)carbonyl, and $R_9$ is $C_{1-4}$alkyl, (b) 5–70% by weight of an organic monobasic acid or a mixture of organic monobasic acids selected from formic, acetic, propionic, butyric, glycollic and lactic acids, (c) 10–45% by weight citric acid, (d) 5–55% by weight water, the total amount of organic acids present being at least 40% by weight of the total composition, and the total amount of components a, b, c and d being at least 90% of the total solution.

2. A solution as claimed in claim 1 in which component (a) is an optical brightening agent of formula

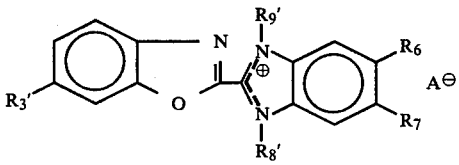

in which $R_3'$ is methoxy or $C_{1-2}$alkoxy carbonyl $R_8'$ is $C_{1-2}$alkyl, unsubstituted or monosubstituted by phenyl or by $C_{1-4}$alkoxy)carbonyl and $R_9'$ is methyl or ethyl.

3. A solution as claimed in claim 2 in which in component (a) $R_3'$ is methoxy, $R_6$ and $R_7$ are hydrogen and $R_8'$ and $R_9'$ are methyl.

4. A solution according to claim 1 in which $A^{\ominus}$ is halide or $CH_3SO_4^{\ominus}$ anion.

5. A solution according to claim 1 in which component (b) is formic, acetic, glycollic or lactic acid or a mixture thereof.

6. A solution according to claim 5 in which component (b) is acetic or glycollic acid or a mixture thereof.

7. A solution according to claim 1 in which the total amount of organic acids present is from 45–65% by weight of the total composition.

8. A solution according to claim 2 containing 7 to 20% component (a), 10 to 30% component (b) and 25 to 40% component (c).

9. A solution according to claim 8 wherein component (b) is acetic or glycollic acid or a mixture thereof.

10. A solution according to claim 3 containing 7 to 20% component (a), 10 to 30% component (b) and 25 to 40% component (c).

11. A solution according to claim 10 wherein component (b) is acetic or glycollic acid or a mixture thereof.

12. A solution according to claim 1 wherein components (b), (c) and (d) are substantially the only solvents.

13. A solution according to claim 2 in which the total amount of organic acids present is from 45–65% by weight of the total composition.

14. A solution according to claim 8 in which the total amount of organic acids present is from 45–65% by weight of the total composition.

15. A solution according to claim 2 wherein $A^{\ominus}$ is a halide or $CH_3SO_4^{\ominus}$ anion.

16. A solution according to claim 8 wherein $A^{\ominus}$ is a halide or $CH_3SO_4^{\ominus}$ anion.

17. A solution according to claim 9 wherein $A^{\ominus}$ is a halide or $CH_3SO_4^{\ominus}$ anion.

18. A solution according to claim 3 wherein components (b), (c) and (d) are substantially the only solvents.

19. A solution according to claim 6 wherein components (b), (c) and (d) are substantially the only solvents.

20. A solution according to claim 1 in which the amount of component (a) is 7–20%, the amount of component (b) is 10–30% and the amount of component (c) is 25 to 40%.

21. A solution according to claim 20 wherein components (b), (c) and (d) are substantially the only solvents.

22. A solution according to claim 8 wherein components (b), (c) and (d) are substantially the only solvents.

* * * * *